US008641427B2

(12) United States Patent
Yu et al.

(10) Patent No.: US 8,641,427 B2
(45) Date of Patent: Feb. 4, 2014

(54) COMBINATIVE TYPE SLIP RING

(75) Inventors: Meng-Chiu Yu, Taichung (TW); Su-Chen Liao, Taichung (TW)

(73) Assignee: Taiwan Long Hawn Enterprise Co., Taichung (TW)

( * ) Notice: Subject to any disclaimer, the term of this patent is extended or adjusted under 35 U.S.C. 154(b) by 27 days.

(21) Appl. No.: 13/345,313

(22) Filed: Jan. 6, 2012

(65) Prior Publication Data

US 2013/0178073 A1 Jul. 11, 2013

(51) Int. Cl.
*H01R 39/00* (2006.01)

(52) U.S. Cl.
USPC ..... 439/26

(58) Field of Classification Search
USPC ..... 439/24–26, 28
See application file for complete search history.

(56) References Cited

U.S. PATENT DOCUMENTS

| | | | | |
|---|---|---|---|---|
| 4,583,797 | A * | 4/1986 | Engelmore et al. | 439/22 |
| 4,921,429 | A * | 5/1990 | Brown | 439/26 |
| 6,089,875 | A * | 7/2000 | Iwata et al. | 439/26 |
| 6,227,866 | B1 * | 5/2001 | Williams et al. | 439/25 |
| 6,561,813 | B2 * | 5/2003 | Rutten et al. | 439/26 |
| 7,131,844 | B1 * | 11/2006 | Wurr | 439/20 |

* cited by examiner

*Primary Examiner* — Gary Paumen
(74) *Attorney, Agent, or Firm* — Tracy M. Heims; Apex Juris, pllc

(57) ABSTRACT

A slip ring includes a spindle and a plurality of insulating rings and conductive rings alternately fitted to the spindle. Each conductive ring is connected with a wire, and the wire extends out of the slip ring through a wire hole of the spindle. The insulating rings engage the spindle so that the insulating rings are unable to rotate relative to the spindle. The conductive rings engage the spindle or the neighboring insulating ring so that conductive rings are unable to rotate relative to the insulating ring. The number and size of the insulating rings and conductive rings are selectable to be fitted to the spindle.

11 Claims, 9 Drawing Sheets

COMBINATIVE TYPE SLIP RING

BACKGROUND OF THE INVENTION

1. Field of the Invention

The present invention relates generally to a slip ring, and more particularly to a combinative type slip ring.

2. Description of the Related Art

Typically, a conventional slip ring has several conductive rings, which are insulated from each other, fitted to a metal tube, and then the conductive rings and the tube are put in a die for injection molding. A covering will embed the conductive rings and the tube to fix the conductive rings to the tube.

The conventional slip ring has a constant size and specification, and it is very difficult to change it because of the covering. The conventional slip ring is unable to add or take off conductive rings. It is because of the covering as well. Therefore, the specified slip ring only serves for specific electronic device.

We believe that the slip ring may have strong competitiveness when the drawbacks as described above are fixed.

SUMMARY OF THE INVENTION

The primary objective of the present invention is to provide a combinative type slip ring, which may be assembled in a fast and stable way, and may change the conductive rings.

According to the objective of the present invention, a slip ring includes a spindle and a plurality of insulating rings and conductive rings alternately fitted to the spindle. The spindle has an axial wire hole. The insulating rings engage the spindle so that the insulating rings are unable to rotate relative to the spindle. The conductive rings engage the spindle or the neighboring insulating ring so that conductive rings are unable to rotate relative to the insulating ring.

In an embodiment, spindle is provided with a slot communicated with the wire hole, and the insulating ring is provided with a protrusion on a sidewall of a central hole to engage the slot of the spindle when the insulating ring is fitted to the spindle.

In an embodiment, the is provided with a slot communicated with the wire hole and two walls at opposite sides of the slot, and the insulating ring is provided with a slot on a sidewall of a central hole to engage the walls of the spindle when the insulating ring is fitted to the spindle.

In an embodiment, the insulating ring has a big ring and small ring fixed to the big ring, and the conductive ring has a central hole to engage the small ring of the insulating ring when the insulating ring and the conductive ring are fitted to the spindle.

In an embodiment, the insulating ring is provided with a slot on a side thereof, and the conductive ring is provided with a protrusion to engage the slot of the insulating ring when the insulating ring and the conductive ring are fitted to the spindle.

In an embodiment, the insulating ring is provided with two posts on a side thereof, and the conductive ring is provided with a protrusion to be rested between the posts of the insulating ring when the insulating ring and the conductive ring are fitted to the spindle.

In an embodiment, the small ring of the insulating ring has a central hole, a trench communicated with the central hole and two posts at opposite side of the trench, and the conductive ring is provided with a protrusion to be rested between the posts of the insulating ring when the insulating ring and the conductive ring are fitted to the spindle, and further wherein conductive ring is provided with an opening on the protrusion, and the opening is communicated with the trench so that a wire passes through the opening on the protrusion and the trench to the wire hole of the spindle.

In an embodiment, an end of the wire is fixed to the conductive ring by a bonding pad, and the insulating ring is provided with a recess to receive the bonding pad when the insulating ring and the conductive ring are fitted to the spindle.

Therefore, the brush holder may be formed by serially connecting the brush holder units in a fast and easy way, and it provides a stable signal transmission.

DETAILED DESCRIPTION OF THE INVENTION

Figure 1:
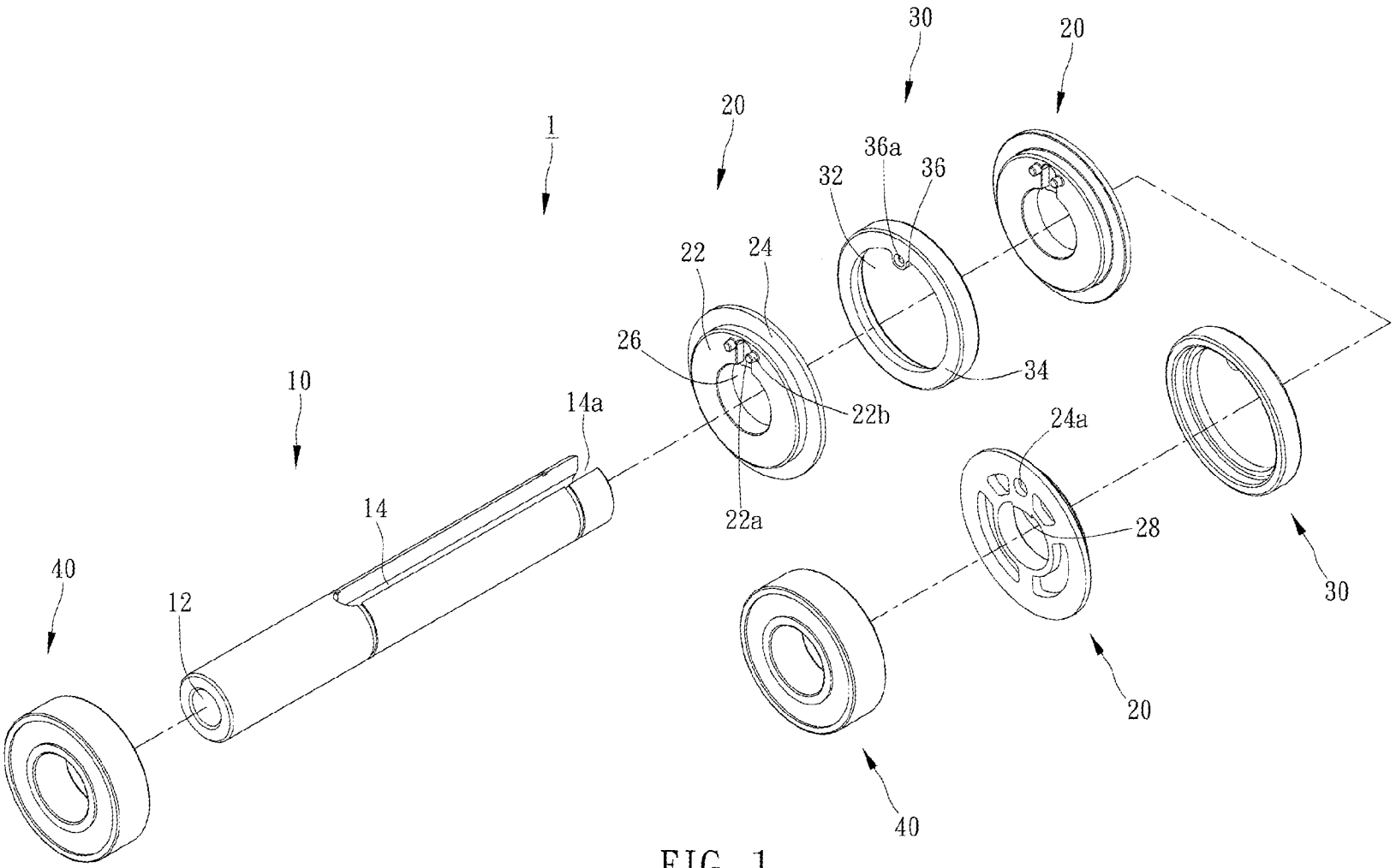
FIG. 1 is an exploded view of a first preferred embodiment of the present invention.

As shown in FIGS. from FIG. 1 to FIG. 6, a combinative type slip ring 1 of the first preferred embodiment of the present invention includes a spindle 10, a plurality of insulating rings 20, a plurality of conductive rings 30, and two bearings 40. Each conductive ring 30 is connected with a wire 2.

The spindle 10 has an axial wire hole 12 and an axial elongated slot 14. The slot 14 has an opening 14*a* at an outer end, and is communicated with the wire hole 12 (FIG. 1). The slot 14 forms a first positioning portion.

The insulating rings 20 are disk-like members, and precisely, each insulating ring 20 has a small ring 22 and a big ring 24 coupled together. The insulating ring 20 has a central hole 26 and a protrusion 28 on a sidewall of the central hole 26. The insulating ring 20 is fitted to the spindle 10 through the central hole 26, and the protrusion 28 engages the slot 14 that the insulating rings 20 may engage the spindle 10 and are unable to rotate. The protrusion 28 forms a second positioning portion.

Figure 3:
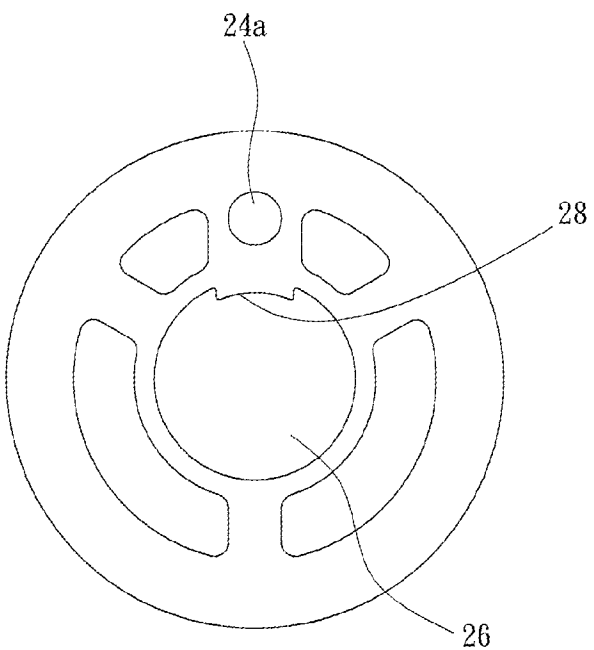
FIG. 3 is a rear view of the insulating ring of the first preferred embodiment of the present invention.
Figure 2:
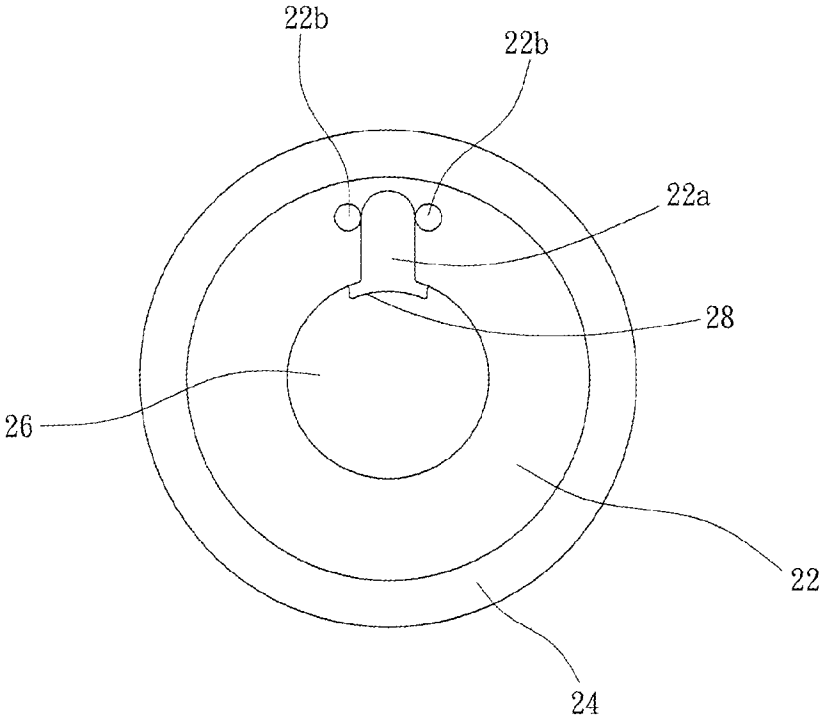
FIG. 2 is a front view of the insulating ring of the first preferred embodiment of the present invention.
Figure 4:
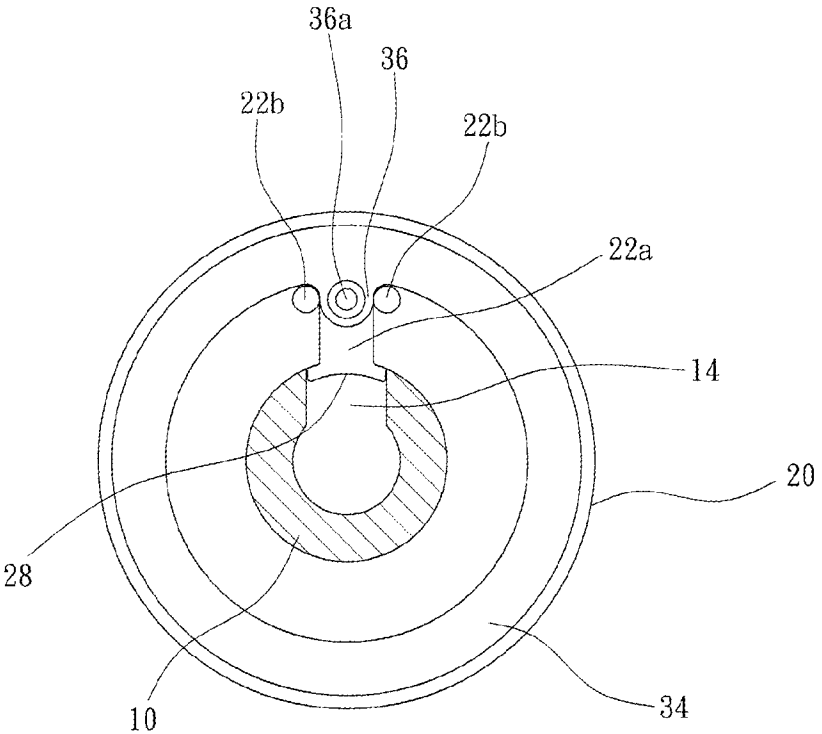
FIG. 4 is a front view of the insulating ring and the conductive ring of the first preferred embodiment of the present invention.
Figure 5:
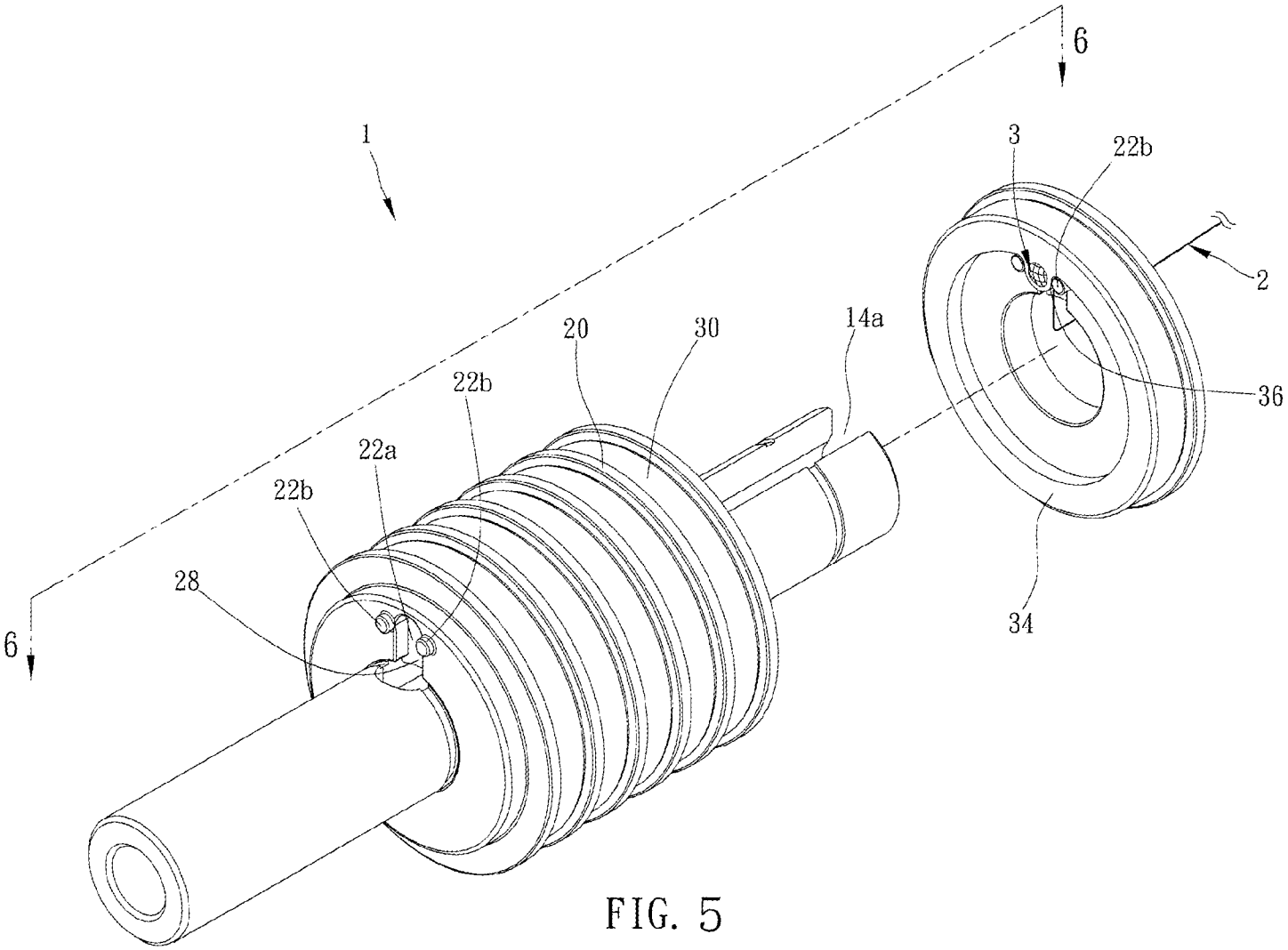
FIG. 5 is a perspective view of the first preferred embodiment of the present invention.

As shown in FIG. 2, the small ring 22 has a trench 22*a* in a radial direction and two posts 22*b* at opposite sides of the trench 22*a*. The trench 22*a* is communicated with the central hole 26. The trench 22*a* will be communicated with the wire hole 12 of the spindle 10 through the slot 14 when the insulating ring 20 is fitted to the spindle 10. The big ring 24 has a recess 24*a* just behind the trench 22*a* (FIG. 3). The posts 22*b* form a third positioning portion.

Figure 6:
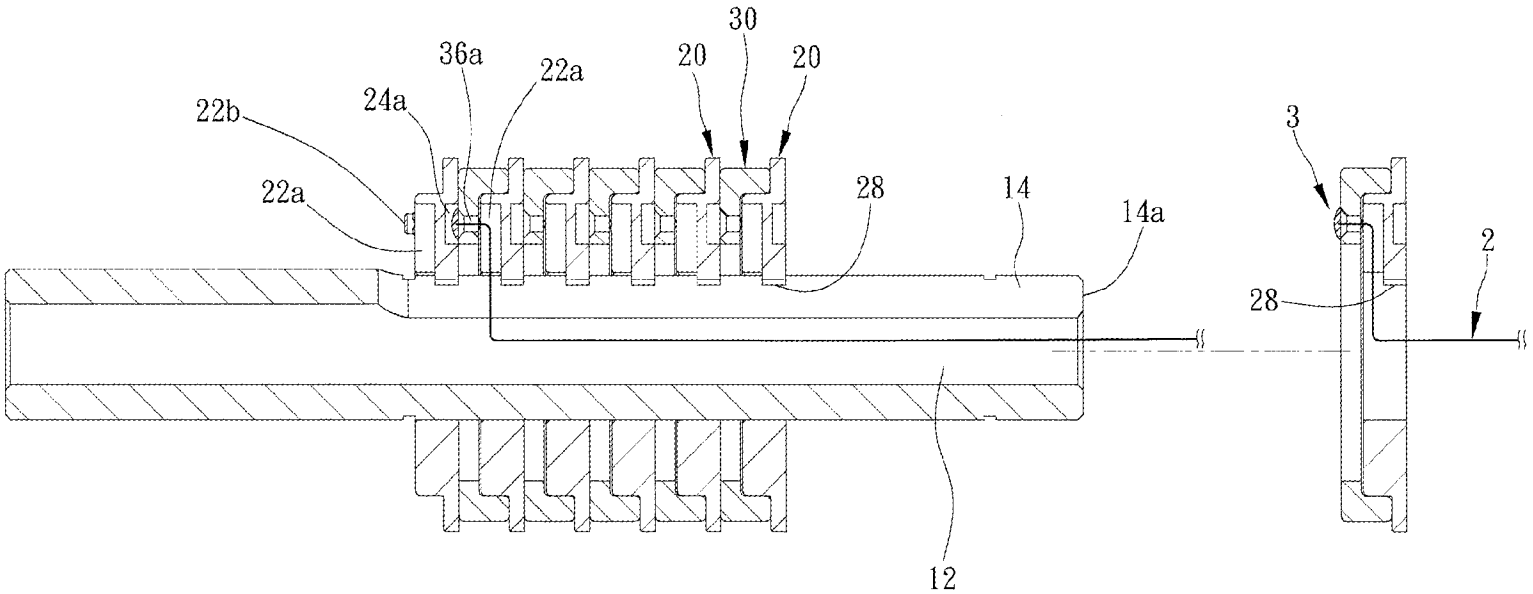
FIG. 6 is a sectional view of the first preferred embodiment of the present invention.

The conductive rings 30 are disk-like members also. Each conductive ring 30 has a central hole 32 to engage the small ring 22 of the insulating ring 20, and the conductive rings 30 will be not in contact with the spindle 10. The conductive ring 30 has a face 34 on a side and a protrusion 36 projected from the sidewall of the central hole 32. The protrusion 36 is rested between the posts 22*b* when the conductive ring 30 engages the insulating ring 20 (FIG. 4) that the conductive ring 30 is unable to rotate. The protrusion 36 forms a fourth positioning portion. The protrusion 36 has an opening 36*a* for the wire 2 to pass through, and then the wire 2 is fixed to protrusion 36 by a bonding pad 3. The bonding pad 3 will be received in the recess 24*a* when the conductive ring 30 engages the insulating ring 20. The other end of the wire 2 passes through the slot 14 and the wire hole 12 of the spindle 10 to connect to an electronic device (FIG. 6).

Figure 7:
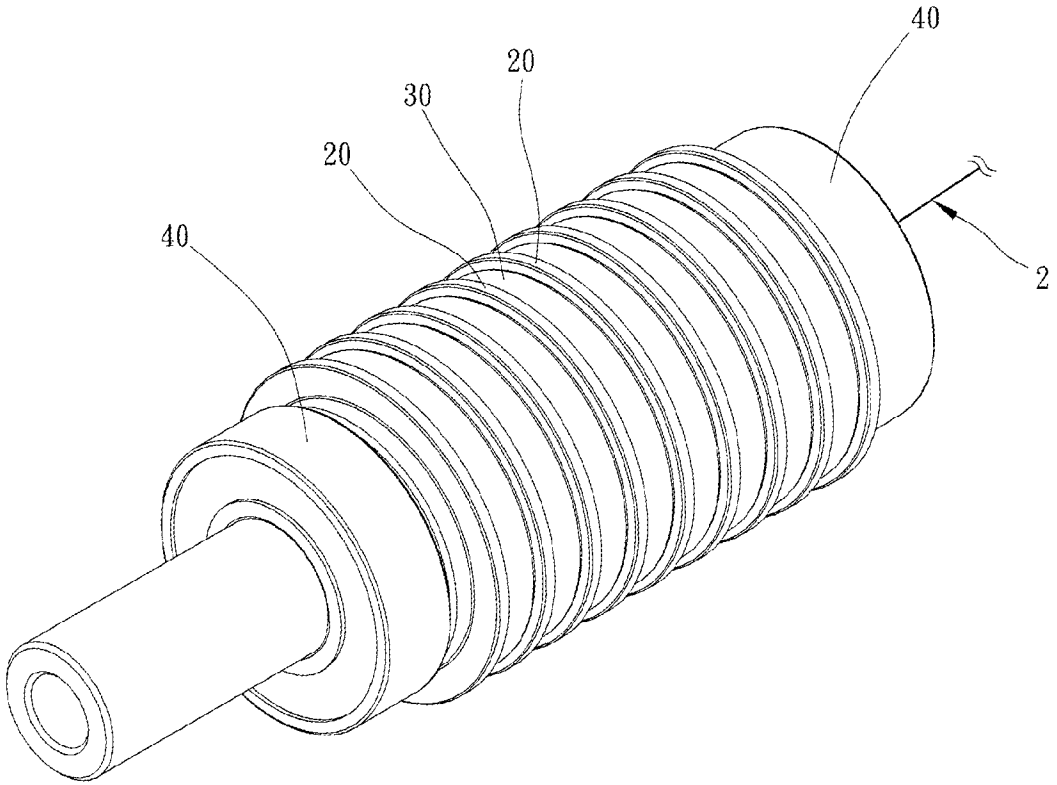
FIG. 7 is a perspective view of the first preferred embodiment of the present invention.

The insulating rings 20 and the conductive rings 30 are alternately fitted to the spindle 10. The insulating rings 20 may insulate the conductive rings 30 from each other and from the spindle as well. The number of the insulating rings 20 and the conductive rings 30 to be fitted to the spindle 10 is selectable according the requirements. At last, the bearings 40 are fitted to the spindle 10 from opposite ends thereof to secure the insulating rings 20 and the conductive rings 30 (FIG. 7).

In the present invention, the first and the last rings on the spindle 10 are the insulating rings 20 to insulate the conductive rings 30 from the bearings 40. It may provide any type of insulating members between the conductive rings 30 and the bearings 40 except the insulating rings 20 mentioned in the present invention.

Figure 8:
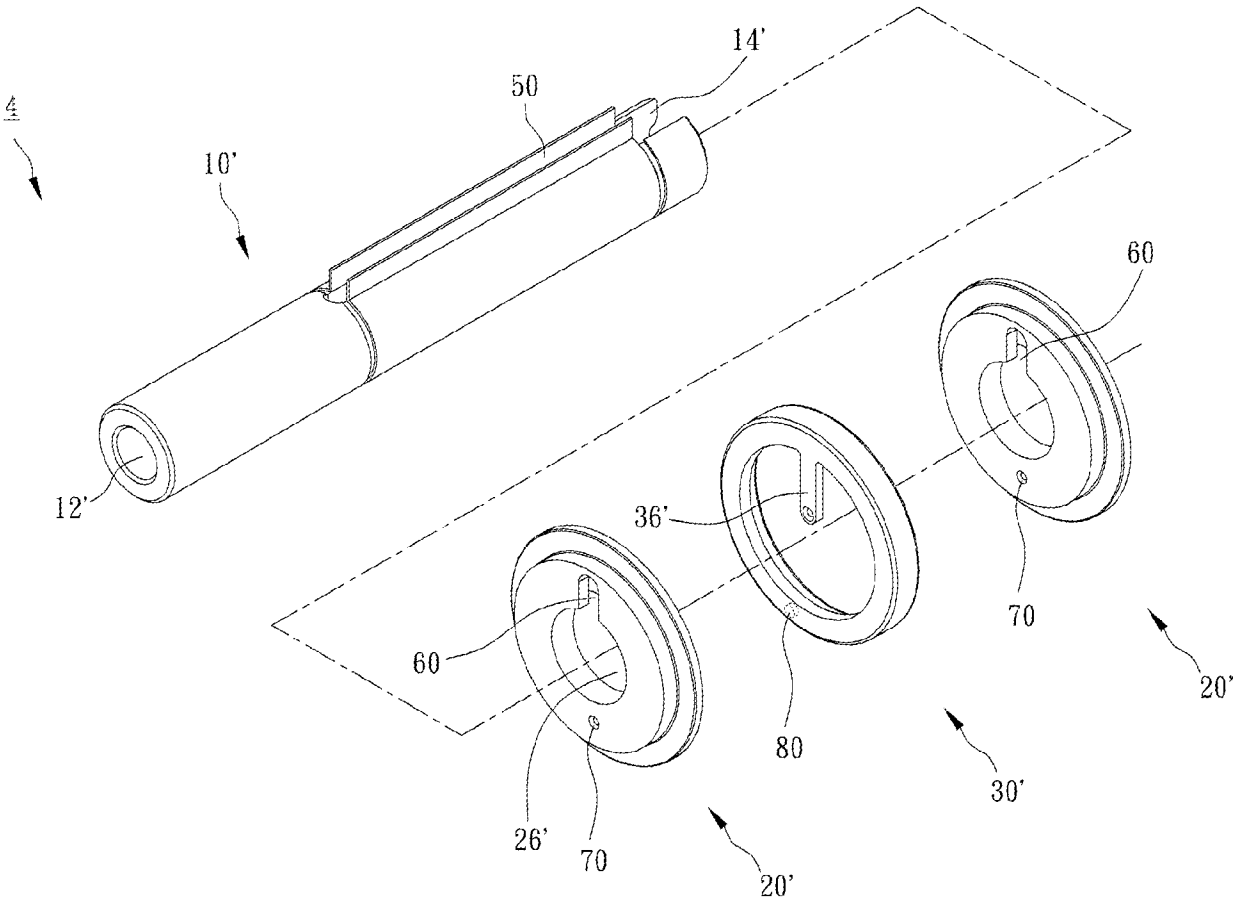
FIG. 8 is a perspective view of a second preferred embodiment of the present invention.
Figure 9:
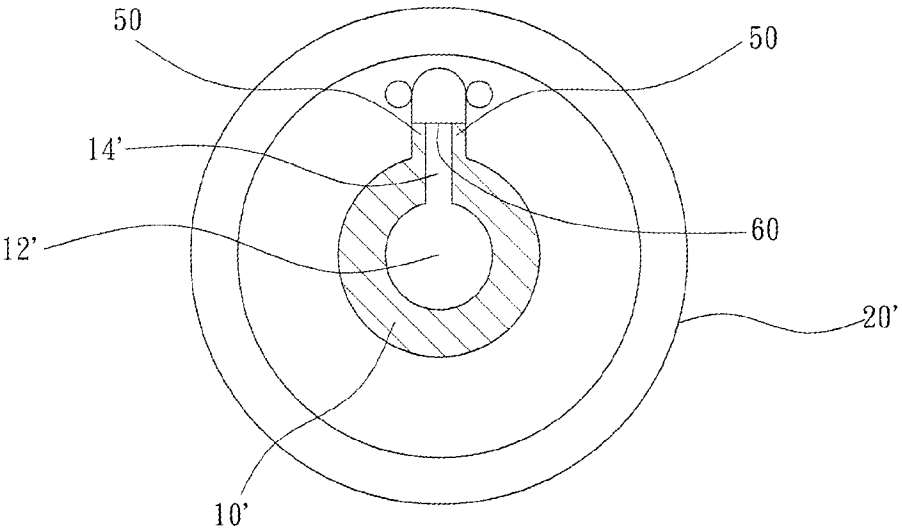
FIG. 9 is a front view of the second preferred embodiment of the present invention.
Figure 10:
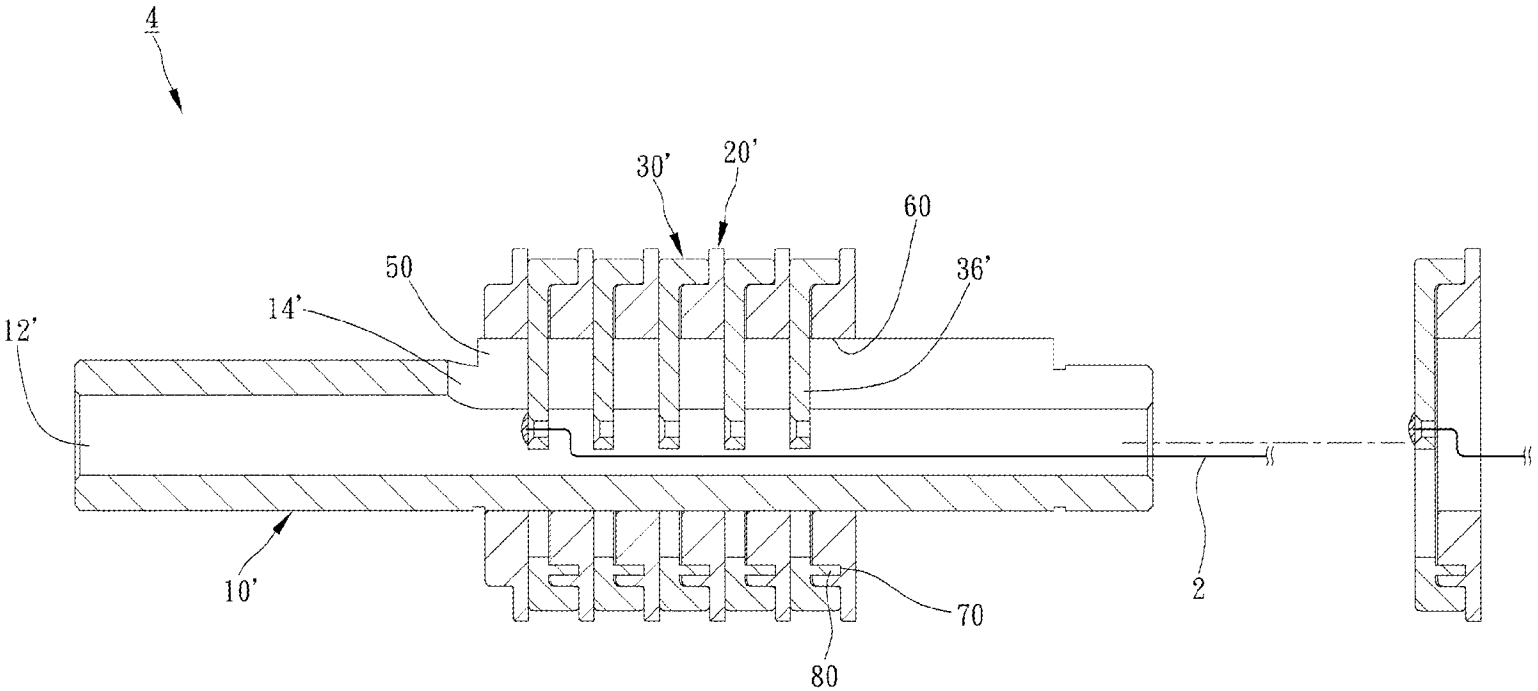
FIG. 10 is a sectional view of the second preferred embodiment of the present invention.

As shown in FIGS. from FIG. 8 to FIG. 10, a slip ring 4 of the second preferred embodiment of the present invention includes a spindle 10', a plurality of insulating rings 20' and conductive rings 30'.

The spindle 10' has a wire hole 12' and a slot 14' communicated with the wire hole 12'. The spindle 10' further has two elongated walls 50 at opposite sides of the slots 14', and the insulating ring 20' has a recess 60 on a sidewall of a central hole 26' thereof to engage the walls 50 when the insulating ring 20' is fitted to the spindle 10' (FIG. 9) that the insulating ring 20' is unable to rotate. The walls 50 of the spindle 10' form the first positioning portion, and the recess 50 of the insulating ring 20' forms the second positioning portion. The insulating ring 20' is provided with a slot 70 on a side thereof, and the conductive ring 30' is provided with a pair of protrusions 80 to engage the slot 70. The slot 70 and the protrusion 80 form the third and the fourth positioning portions. The protrusions 36' of the conductive rings 30' enter the wire hole 12' of the spindle 10' to pass the wire 2.

The functions of the combinative slip ring of the present invention include:

1. No covering is needed to secure the conductive rings 20, so that the present invention may be assembled in a fast and easy way.
2. The number and module of the insulating rings 20' are selectable to be fitted to the spindle 10, that is, we may select the very slip rings to meet our needs.
3. No glue or other fixing means is needed to fix the insulating rings 20 and conductive rings 30. Therefore, it only needs to disassemble the malfunctioned ring from the spindle, and replace a new one.

The present invention provides the slip rings to be assembled and disassembled in a fast and easy way. The specification and function of the slip ring of the present invention may be adjusted by adding or removing the conductive ring(s) for to increase the competitiveness.

The description above is a few preferred embodiments of the present invention. Any structure that involves the engagement of several brush holder units to form the brush holder should be in the scope of the present invention. These equivalences of the present invention are still in the scope of claim construction of the present invention.

What is claimed is:

1. A slip ring, comprising:

a spindle having an axial wire hole and a first positioning portion;

at least an insulating ring fitted to the spindle, wherein the insulating ring has a second positioning portion to engage the first positioning portion of the spindle so that the insulating ring is unable to rotate relative to the spindle; and at least a conductive ring engaging the insulating ring, wherein the conductive ring is unable to rotate relative to the insulating ring;

wherein the spindle is provided with a slot communicated with the wire hole, whereby at least a wire passes through the wire hole of the spindle and is connected to the conductive ring through the slot.

2. The slip ring as defined in claim 1, wherein the insulating ring is provided with a protrusion on a sidewall of a central hole to engage the slot of the spindle when the insulating ring is fitted to the spindle.

3. The slip ring as defined in claim 1, wherein the spindle is provided with two walls at opposite sides of the slot, and the insulating ring is provided with a slot on a sidewall of a central hole to engage the walls of the spindle when the insulating ring is fitted to the spindle.

4. The slip ring as defined in claim 1, wherein the insulating ring has a big ring and a small ring fixed to the big ring, and the conductive ring has a central hole to engage the small ring of the insulating ring.

5. The slip ring as defined in claim 1, wherein the insulating ring is provided with a slot on a side thereof, and the conductive ring is provided with a protrusion to engage the slot of the insulating ring.

6. The slip ring as defined in claim 1, wherein the insulating ring is provided with two posts on a side thereof, and the conductive ring is provided with a protrusion to be rested between the posts of the insulating ring.

7. The slip ring as defined in claim 4, wherein the small ring of the insulating ring has a central hole, a trench communicated with the central hole and two posts at opposite side of the trench, and the conductive ring is provided with a protrusion to be rested between the posts of the insulating ring, and further wherein conductive ring is provided with an opening on the protrusion, and the opening is communicated with the trench so that a wire passes through the opening on the protrusion and the trench to the wire hole of the spindle.

8. The slip ring as defined in claim 7, wherein an end of the wire is fixed to the conductive ring by a bonding pad, and the insulating ring is provided with a recess to receive the bonding pad when the insulating ring and the conductive ring are fitted to the spindle.

9. The slip ring as defined in claim 2, wherein the insulating ring is provided with two posts on a side thereof, and the conductive ring is provided with a protrusion to be rested between the posts of the insulating ring.

10. The slip ring as defined in claim 2, wherein the insulating ring has a big ring and a small ring fixed to the big ring, and the conductive ring has a central hole to engage the small ring of the insulating ring.

11. The slip ring as defined in claim 10, wherein the small ring of the insulating ring has a central hole, a trench communicated with the central hole and two posts at opposite side of the trench, and the conductive ring is provided with a protrusion to be rested between the posts of the insulating ring, and further wherein conductive ring is provided with an opening on the protrusion, and the opening is communicated with the trench so that a wire passes through the opening on the protrusion and the trench to the wire hole of the spindle.

* * * * *